US009138065B2

(12) United States Patent
Chandler

(10) Patent No.: US 9,138,065 B2
(45) Date of Patent: Sep. 22, 2015

(54) BED WITH MATTRESS ASSEMBLY HAVING ONE OR MORE INTERNAL PLATES

(71) Applicant: Kelly Wood Chandler, Gate City, VA (US)

(72) Inventor: Kelly Wood Chandler, Gate City, VA (US)

(73) Assignee: Tempur-Pedic Management, LLC, Lexington, KY (US)

( * ) Notice: Subject to any disclaimer, the term of this patent is extended or adjusted under 35 U.S.C. 154(b) by 0 days.

(21) Appl. No.: 14/110,990

(22) PCT Filed: Dec. 28, 2012

(86) PCT No.: PCT/US2012/072022

§ 371 (c)(1),
(2) Date: Oct. 10, 2013

(87) PCT Pub. No.: WO2014/105046

PCT Pub. Date: Jul. 3, 2014

(65) Prior Publication Data

US 2014/0182058 A1 Jul. 3, 2014

(51) Int. Cl.

| | |
|---|---|
| ***A47C 19/04*** | (2006.01) |
| ***A47C 27/14*** | (2006.01) |
| ***A47C 27/15*** | (2006.01) |
| ***A47C 27/16*** | (2006.01) |

(52) U.S. Cl.

CPC ..... *A47C 19/045* (2013.01); *A47C 27/148* (2013.01); *A47C 27/15* (2013.01); *A47C 27/16* (2013.01)

(58) Field of Classification Search

CPC .. A47C 23/0435; A47C 27/148; A47C 27/15; A47C 27/061; A47C 19/045; A47C 19/00; A47C 19/02

USPC ..... 5/11, 630, 691, 701, 722, 655.9, 727, 5/697, 611, 659

See application file for complete search history.

(56) References Cited

U.S. PATENT DOCUMENTS

| | | | | | |
|---|---|---|---|---|---|
| 2,072,791 | A | * | 3/1937 | Baer | 248/407 |
| 2,257,994 | A | * | 10/1941 | Zofnass | 5/696 |
| 2,543,218 | A | * | 2/1951 | Young et al. | 5/701 |
| 2,558,288 | A | * | 6/1951 | Backus | 5/248 |
| 2,842,784 | A | * | 7/1958 | Grund | 5/697 |
| 2,935,813 | A | * | 5/1960 | Berman et al. | 248/188.2 |

(Continued)

OTHER PUBLICATIONS

International Searching Authority, International Search Report and Written Opinion, Sep. 5, 2013, 11pages.

*Primary Examiner* — Nicholas Polito
*Assistant Examiner* — Eric Kurilla
(74) *Attorney, Agent, or Firm* — J. Mark Wilkinson

(57) ABSTRACT

A bed is provided that includes a foundation configured to be positioned on an underlying floor and a mattress assembly supported on and secured to the foundation. The mattress assembly includes a base layer and a body supporting portion. One or more internal plates are interposed between the base layer and the body supporting portion of the mattress assembly and are maintained at a fixed height relative to the underlying floor. The foundation and the mattress assembly are moveable between at least a first predetermined height and a second predetermined height relative to the underlying floor. As a result of the movement of the foundation and the mattress assembly between the first predetermined height and the second predetermined height, the one or more internal plates apply pressure to and compress the body supporting portion of the mattress assembly, thus increasing the firmness of the body supporting portion.

12 Claims, 6 Drawing Sheets

(56) References Cited

U.S. PATENT DOCUMENTS

| | | | | | |
|---|---|---|---|---|---|
| 2,985,895 | A | * | 5/1961 | Bloom | 5/248 |
| 3,059,249 | A | * | 10/1962 | Kamp | 5/246 |
| 3,118,153 | A | * | 1/1964 | Hood | 428/218 |
| 3,125,768 | A | * | 3/1964 | Rickert | 5/659 |
| 3,551,924 | A | * | 1/1971 | Frye | 5/722 |
| 3,739,409 | A | * | 6/1973 | Johnson | 5/697 |
| 3,751,742 | A | * | 8/1973 | Worley | 5/659 |
| 4,122,568 | A | * | 10/1978 | Bastos et al. | 5/690 |
| 4,222,137 | A | * | 9/1980 | Usami | 5/727 |
| 4,667,357 | A | * | 5/1987 | Fortune | 5/697 |
| 4,860,396 | A | * | 8/1989 | Vogel, II | 5/659 |
| 5,016,268 | A | * | 5/1991 | Lotman | 378/177 |
| 5,121,516 | A | * | 6/1992 | Jones | 5/658 |
| 5,134,731 | A | * | 8/1992 | Quintile et al. | 5/11 |
| 5,172,442 | A | * | 12/1992 | Bartley et al. | 5/611 |
| 5,341,820 | A | * | 8/1994 | Hammett | 5/611 |
| 5,513,402 | A | | 5/1996 | Schwartz | |
| 5,688,287 | A | * | 11/1997 | Cline | 5/310 |
| 5,850,648 | A | * | 12/1998 | Morson | 5/724 |
| 6,003,178 | A | * | 12/1999 | Montoni | 5/690 |
| 6,154,901 | A | * | 12/2000 | Carr | 5/621 |
| 6,216,289 | B1 | * | 4/2001 | Woods | 5/200.1 |
| 6,353,952 | B1 | * | 3/2002 | Wells | 5/716 |
| 6,678,907 | B1 | * | 1/2004 | Voelker et al. | 5/611 |
| 6,820,294 | B2 | * | 11/2004 | Shiery et al. | 5/611 |
| 6,871,369 | B1 | * | 3/2005 | Long | 5/659 |
| 6,996,865 | B2 | * | 2/2006 | Sabin | 5/716 |
| 7,296,310 | B2 | * | 11/2007 | Kozlowski et al. | 5/400 |
| 7,469,437 | B2 | * | 12/2008 | Mikkelsen et al. | 5/740 |
| 7,503,084 | B1 | * | 3/2009 | Terry | 5/8 |
| 7,647,659 | B2 | * | 1/2010 | Frolik et al. | 5/509.1 |
| 7,934,277 | B1 | * | 5/2011 | Shu | 5/690 |
| 8,328,287 | B2 | * | 12/2012 | Hsu | 297/452.1 |
| 8,375,492 | B2 | * | 2/2013 | Hsu | 5/697 |
| 8,418,297 | B2 | * | 4/2013 | Mikkelsen et al. | 5/740 |
| 8,418,298 | B2 | * | 4/2013 | Jones | 5/740 |
| 8,438,681 | B2 | * | 5/2013 | Viberg | 5/716 |
| 8,613,119 | B2 | * | 12/2013 | Hsu | 5/600 |
| 2006/0053550 | A1 | * | 3/2006 | Snyder et al. | 5/11 |
| 2007/0074344 | A1 | * | 4/2007 | Cloer et al. | 5/310 |
| 2008/0276377 | A1 | * | 11/2008 | Hsu | 5/727 |
| 2010/0058541 | A1 | | 3/2010 | Kemper | |
| 2010/0235997 | A1 | * | 9/2010 | Jones | 5/694 |
| 2011/0047707 | A1 | * | 3/2011 | Hobson | 5/691 |
| 2011/0099722 | A1 | * | 5/2011 | Moret et al. | 5/701 |
| 2011/0252572 | A1 | * | 10/2011 | Morrison | 5/740 |

* cited by examiner

BED WITH MATTRESS ASSEMBLY HAVING ONE OR MORE INTERNAL PLATES

TECHNICAL FIELD

The present invention relates to a bed having a mattress assembly made of multiple layers, and, more particularly, to a bed having a mattress assembly made of multiple layers of visco-elastic or other flexible foams and including one or more internal plates that are used to adjust the firmness of at least one of the layers of the mattress assembly.

BACKGROUND

Visco-elastic and other flexible foams are increasingly used in the manufacture of mattress assemblies due to their ability to conform to the shape of a user and provide support to the entirety of a user's body. Many such mattress assemblies are actually comprised of multiple layers of visco-elastic or other flexible foams which work together to provide a desired degree of comfort and support. Such multi-layered mattress assemblies are described, for example, in U.S. Pat. No. 7,469,137; U.S. Pat. No. 7,507,468; U.S. Pat. No. 8,025,964; U.S. Pat. No. 8,034,445; and U.S. Patent Application Publication No. 2011/0252562, each of which is incorporated herein by this reference. However, despite the advantageous properties of such mattress assemblies that make use of visco-elastic or other flexible foams, some users still have difficulty transitioning into and out of a bed. In other words, some users, especially those who are physically weak or infirm, may have difficulty transitioning to a supine position (i.e., getting into bed), or, more commonly, sitting up and transitioning to a standing position (i.e., getting out of bed).

SUMMARY

The present invention is a bed having a mattress assembly made of multiple layers of visco-elastic or other flexible foams and including one or more internal plates that are used to adjust the firmness of at least one of the layers of the mattress assembly.

In some exemplary embodiments of the present invention, a bed is comprised of: a foundation; a mattress assembly, including a base layer and a body supporting portion with an optional upper comfort layer; and one or more internal plates interposed between the base layer and the body supporting portion of the mattress assembly.

The base layer is a support layer providing a relatively stiff substrate upon which the body supporting portion lies, while still having a degree of deformability to provide user comfort, at least to the extent that the weight of the user affects the shape of the base layer. The base layer is thus generally comprised of a flexible foam having a relatively high resilience, such as a high-resilience polyurethane foam.

The body supporting portion of the mattress assembly is generally comprised of a flexible foam having a density suitable for distributing pressure from a user's body, or portion thereof, across the body supporting portion of the mattress assembly. Such flexible foams include, but are not limited to: latex foam; reticulated or non-reticulated visco-elastic foam (sometimes referred to as memory foam or low-resilience foam); reticulated or non-reticulated non-visco-elastic foam; high-resilience polyurethane foam; expanded polymer foams (e.g., expanded ethylene vinyl acetate, polypropylene, polystyrene, or polyethylene); and the like.

The body supporting portion of the mattress assembly further includes an upper comfort layer that is positioned atop the body supporting portion and provides a level of comfort to a body of a user or a portion thereof that is resting on the mattress assembly. The comfort layer is also preferably comprised of a visco-elastic foam. However, the comfort layer typically has a density, hardness, or both that is less than that of the body supporting portion of the mattress assembly, such that the comfort layer provides a softer surface on which to rest the body of a user or a portion thereof.

The base layer, the body supporting portion, and the comfort layer are preferably secured to one another to create an integrated mattress assembly and to prevent the base layer, the body supporting portion, and the comfort layer from unnecessarily moving relative to one another during use. Furthermore, the mattress assembly is secured to the foundation.

The one or more internal plates are preferably made from metal and are interposed between the base layer and the body supporting portion of the mattress assembly. The one or more internal plates are also secured to and supported on one or more legs that extend through the base layer and through the foundation, with feet at the distal end of each of the one or more legs engaging the underlying floor. The legs maintain one or more internal plates at a fixed height relative to the underlying floor.

The remainder of the bed is supported on adjustable legs that extend from a lower surface of the foundation. When the bed is moved from a first predetermined height to a second predetermined height relative to the underlying floor, the one or more internal plates apply pressure to and compress the body supporting portion of the mattress assembly, thus increasing the firmness of the body supporting portion. Such increased firmness makes it easier for a user to transition to a supine position on the surface of the mattress assembly (i.e., get into bed), or to sit up and transition to a standing position (i.e., get out of bed).

Further features and advantages of the present invention will become evident to those of ordinary skill in the art after a study of the description, figures, and non-limiting examples in this document.

DESCRIPTION OF EXEMPLARY EMBODIMENTS

The present invention is a bed having a mattress assembly made of multiple layers of visco-elastic or other flexible foams and including one or more internal plates that are used to adjust the firmness of at least one of the layers of the mattress assembly.

Figure 1:
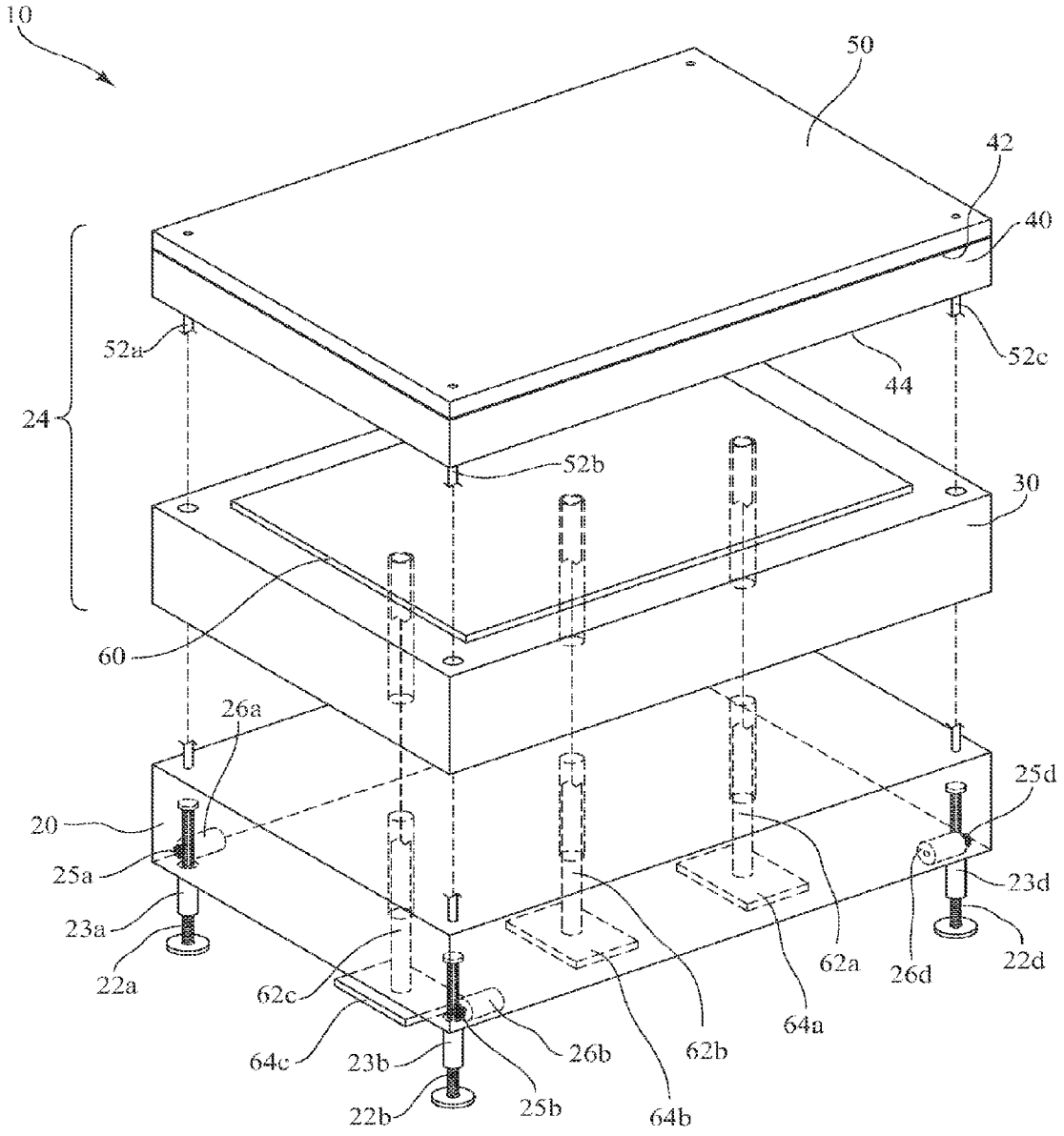
FIG. 1 is an exploded perspective view of an exemplary bed made in accordance with the present invention.
Figure 2:
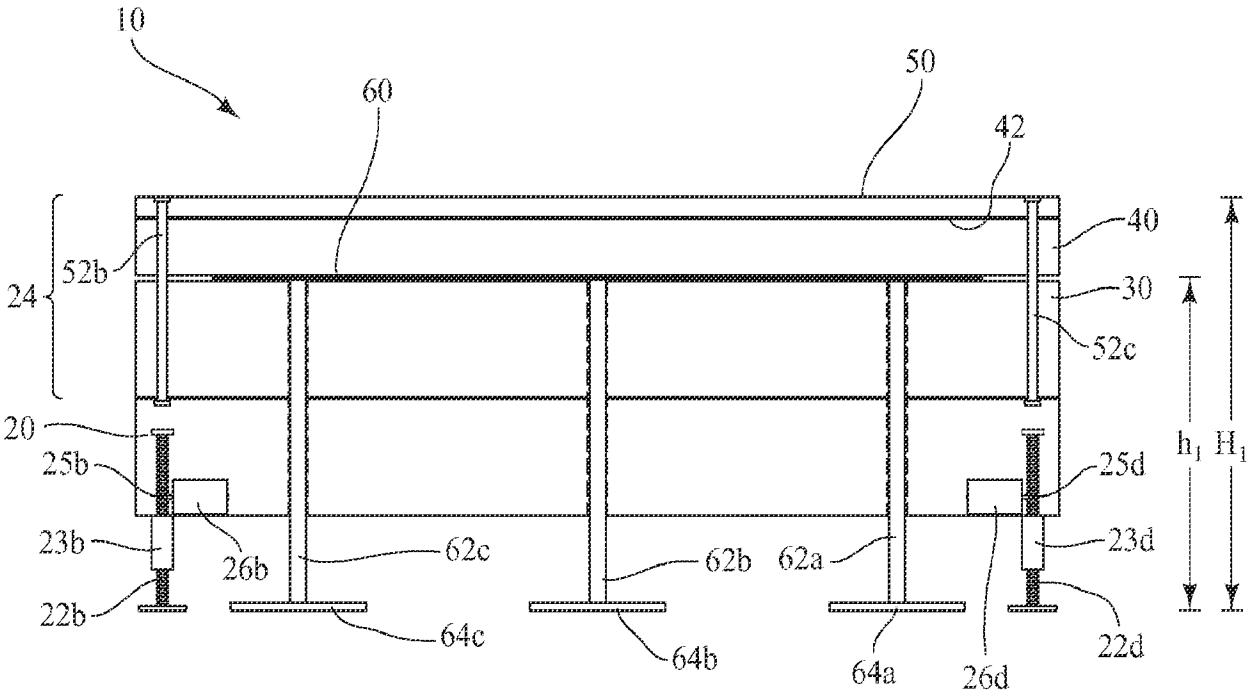
FIG. 2 is a side sectional view of the bed of FIG. 1 in an assembled form.
Figure 3:
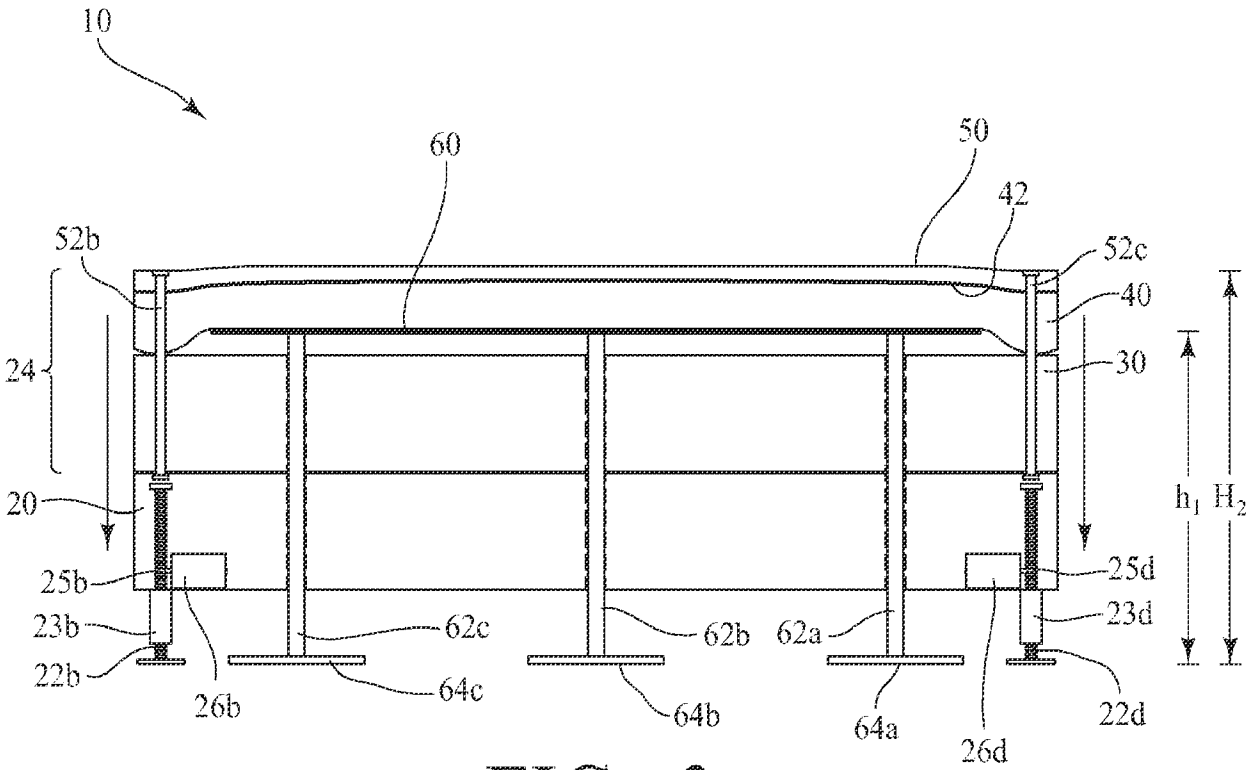
FIG. 3 is a side sectional view of the bed of FIG. 1 in an assembled form, where the height of the foundation of the bed has been lowered relative to the underlying floor.

Referring first to FIGS. 1-3, in one exemplary embodiment of the present invention, a bed 10 is comprised of: a foundation 20; a mattress assembly 24, including a base layer 30 and a body supporting portion 40 with an optional upper comfort layer 50; and an internal plate 60 interposed between en the base layer 30 and the body supporting portion 40 of the mattress assembly 24.

Referring still to FIGS. 1-3, the base layer 30 is a support layer providing a relatively stiff substrate upon which the body supporting portion 40 (described below) lies, while still having a degree of deformability to provide user comfort, at least to the extent that the weight of the user affects the shape of the base layer 30. The base layer 30 is thus generally comprised, of a foam having a relatively high resilience, such as a high-resilience polyurethane foam. In some embodiments, the base layer 30 has a hardness of at least about 50 N and no greater than about 300 N for a desirable degree of support and comfort. In other embodiments, the base layer 30 has a hardness of at least about 80 N and no greater than about 250 N. In still other embodiments, the base layer 30 has a hardness of at least about 90 N and no greater than about 180 N.

Referring still to FIGS. 1-3, the body supporting portion 40 of the mattress assembly 24 has a first (or upper) surface 42 and a second (or lower) surface 44. The body supporting portion 40 is generally comprised of a flexible foam having a density suitable for distributing pressure from a user's body, or portion thereof, across the body supporting portion 40 of the mattress assembly 24. Such flexible foams include, but are not limited to: latex foam; reticulated or non-reticulated visco-elastic foam (sometimes referred to as memory foam low-resilience foam; reticulated or non-reticulated non-visco-elastic foam; high-resilience polyurethane foam; expanded polymer foams (e.g., expanded ethylene vinyl acetate, polypropylene, polystyrene, or polyethylene); and the like. In the exemplary embodiment shown in FIGS. 1-3, the body supporting portion 40 is comprised of a visco-elastic foam that has a low resilience, but sufficient hardness and density so that pressure is distributed evenly across the body supporting portion 40 of the mattress assembly 24.

With respect to hardness, suitable visco-elastic foams for the body supporting portion 40 have a hardness of at least about 10 N to no greater than about 80 N, as measured by exerting pressure from a plate against a sample of the material to a compression of at least 40% of an original thickness of the material at approximately room temperature (i.e., 21° C. to 23° C.), where the 40% compression is held for a set period of time as established by the International Organization of Standardization (ISO) 2439 hardness measuring standard. In some embodiments, the visco-elastic foam that comprises the body supporting portion 40 has a hardness of about 10 N, about 20 N, about 30 N, about 40 N, about 50 N, about 60 N, about 70 N, or about 80 N to provide a desired degree of comfort and body-conforming qualities.

With respect to density, suitable visco-elastic foams for the body supporting portion 40 have a density that also assists in providing a desired degree of comfort and body-conforming qualities, as well as an increased degree of material durability. In some embodiments, the density of the visco-elastic foam that comprises the body supporting portion 40 of the mattress assembly 24 has a density of no less than about 30 kg/m$^3$ to no greater than about 150 kg/m$^3$. In some embodiments, the density of the visco-elastic foam that comprises the body supporting portion 40 of the mattress assembly 24 is about 30 kg/m$^3$, about 40 kg/m$^3$, about 50 kg/m$^3$, about 60 kg/m$^3$, about 70 kg/m$^3$, about 80 kg/m$^3$, about 90 kg/m$^3$, about 100 kg/m$^3$, about 110 kg/m$^3$, about 120 kg/m$^3$, about 130 kg/m$^3$, about 140 kg/m$^3$; or about 150 kg/m$^3$. Of course, the selection of a visco-elastic foam having a particular density will affect other characteristics of the foam, including its hardness, the manner in which the foam responds to pressure, and the overall feel of the foam, but it should be appreciated that a visco-elastic foam having a desired density and hardness can readily be selected for a particular application or mattress assembly as desired.

Referring still to FIGS. 1-3, in this exemplary embodiment, the body supporting portion 40 of the mattress assembly 24 farther includes an upper comfort layer 50 that is positioned atop the body supporting portion 40 and provides a level of comfort to a body of user or a portion of thereof that is resting on the mattress assembly 24. The comfort layer 50 so preferably comprised of a visco-elastic foam. However, the comfort layer 50 typically has a density, hardness, or both that is less than that of the body supporting portion 40 of the mattress assembly 24, such that the comfort layer 50 provides a softer surface on which to rest the body of a user or a portion thereof. For example, in some embodiments, the mattress assembly 24 includes a body supporting portion 40 that is comprised of visco-elastic foam with a density of about 80 kg/m$^3$ and a hardness of about 13 N, while the comfort layer 50 is comprised of a visco-elastic foam with a density of about 35 kg/m$^3$ and a hardness of about 10 N.

Regardless of the particular hardness and density of the materials (e.g., the foams) used, the base layer 30, the body supporting portion 40, and the comfort layer 50 are preferably secured to one another to create an integrated mattress assembly 24 and to prevent base layer 30, the body supporting portion 40, and the comfort layer 50 from unnecessarily moving relative to one another during use. Various means of securing one layer of material to another can be used in this regard, including tape, hook and loop fasteners, conventional fasteners, stitches, and the like. In one particular embodiment, the base layer 30, the body supporting portion 40, and the comfort layer 50 are bonded together by an adhesive or cohesive bonding material. Suitable adhesive bonding materials include, for example, environmentally-friendly, water-based adhesives, like SABA AQUABOND RSD, a two-component water-based adhesive product produced by SABA DINXPERLO BV, B-7090 AA, Dinxperlo, Belgium.

Furthermore, in order for the internal plate 60 to function as intended (as described in further detail below), the mattress assembly 24 must be secured to the foundation 20. Accordingly, as best shown in FIG. 1, bolts 52*a*, 52*b*, 52*c*, 52*d* or similar fasteners are passed through each corner of the mattress assembly 24 and advanced into the foundation 20 to secure the mattress assembly 24 to the foundation 20.

Referring still to FIGS. 1-3, the internal plate 60 is preferably made from metal, such as stainless steel. Other rigid or semi-rigid materials can also be used. As mentioned above, the internal plate 60 is interposed between the base layer 30 and the body supporting portion 40 of the mattress assembly 24. And, in this exemplary embodiment, the internal plate 60 has a surface area that is substantially coextensive with the lower surface 44 of the body supporting portion 40. The internal plate 60 is also secured to and supported on one or more legs 62*a*, 62*b*, 62*c* that extend through the base layer 30 and through the foundation 20, with feet 64*a*, 64*b*, 64*c* at the distal end of each of the one or more legs 62*a*, 62*b*, 62*c* engaging the underlying floor.

Referring now to FIGS. 2-3, the one or more legs 62*a*, 62*b*, 62*c* c support the internal plate 60 maintain the internal plate 60 at a fixed height, $h_1$, relative to the underlying floor. The remainder of the bed 10 is supported on adjustable legs 22*a*, 22*b*, 22*c*, 22*d* that extend from a lower surface of the foundation 20. In FIG. 2, the bed 10 is set at a first predetermined height, $H_1$, while, in FIG. 3, the bed 10 is lowered to a second predetermined height, $H_2$. Comparing FIG. 2 to FIG. 3, as a result of the downward adjustment of the height of the bed 10, and since the internal plate 60 is at a fixed height, $h_1$, relative to the underlying floor, the internal plate 60 applies an upward pressure on the lower surface 44 of the body supporting portion 40. Since mattress assembly 24 is secured to the foundation 20, the visco-elastic foam of the body supporting portion 40 is effectively compressed, thus increasing the firmness of the body supporting portion 40. Such increased firmness makes it easier for a user to transition to a supine position on the surface of the mattress assembly 24 (i.e., get into bed), or to sit up and transition to a standing position (i.e., get out of bed). At the same time, by lowering the bed to the second predetermined height, $H_2$, there is also the additional benefit of moving the upper surface of the bed 10 closer to the floor when a user is getting into out of the bed 10.

With respect to the adjustable legs 22*a*, 22*b*, 22*c*, 22*d* and the raising and/or lowering of the bed 10, this can be achieved in a number of ways without departing from the spirit and scope of the present invention. For example, in the exemplary embodiment shown in FIGS. 1-3 each of the adjustable legs 22*a*, 22*b*, 2*c*, 22*d* is threaded along part of its length so that it can be extended or retracted from a corresponding threaded holder 23*a*, 23*b*, 23*c*, 23*d* by rotation of each adjustable leg 22*a*, 22*b*, 22*d*. Furthermore, the threaded portion of each of the adjustable leas 22*a*, 22*b*, 22*c*, 22*d* functions as a worm that can be driven by a corresponding worm gear 25*a*, 25*b*, 25*c*, 25*d* in a worm gear arrangement. Thus, a motor 26*a*, 26*b*, 26*c*, 26*d* drives each worm gear 25*a*, 25*b*, 25*e*, 25*d*, which then rotates the respective adjustable leg 22*a*, 22*b*, 22*c*, 22*d* to achieve the desired raising or lowering of the bed 10. The motor 26*a*, 26*b*, 26*c*, 26*d* can be selectively actuated, for example, by a remote control unit that sends appropriate signals to the motors 26*a*, 26*b*, 26*c*, 26*d* in response to user input. Again, however, this is but one example of how the raising and/or lowering of the bed 10 can be achieved, and alternate manual and automated adjustment means, such as those described, for example in U.S. Pat. No. 5,090,070, which is incorporated herein by reference, may be used without departing from the spirit and scope of the present invention.

Figure 4:
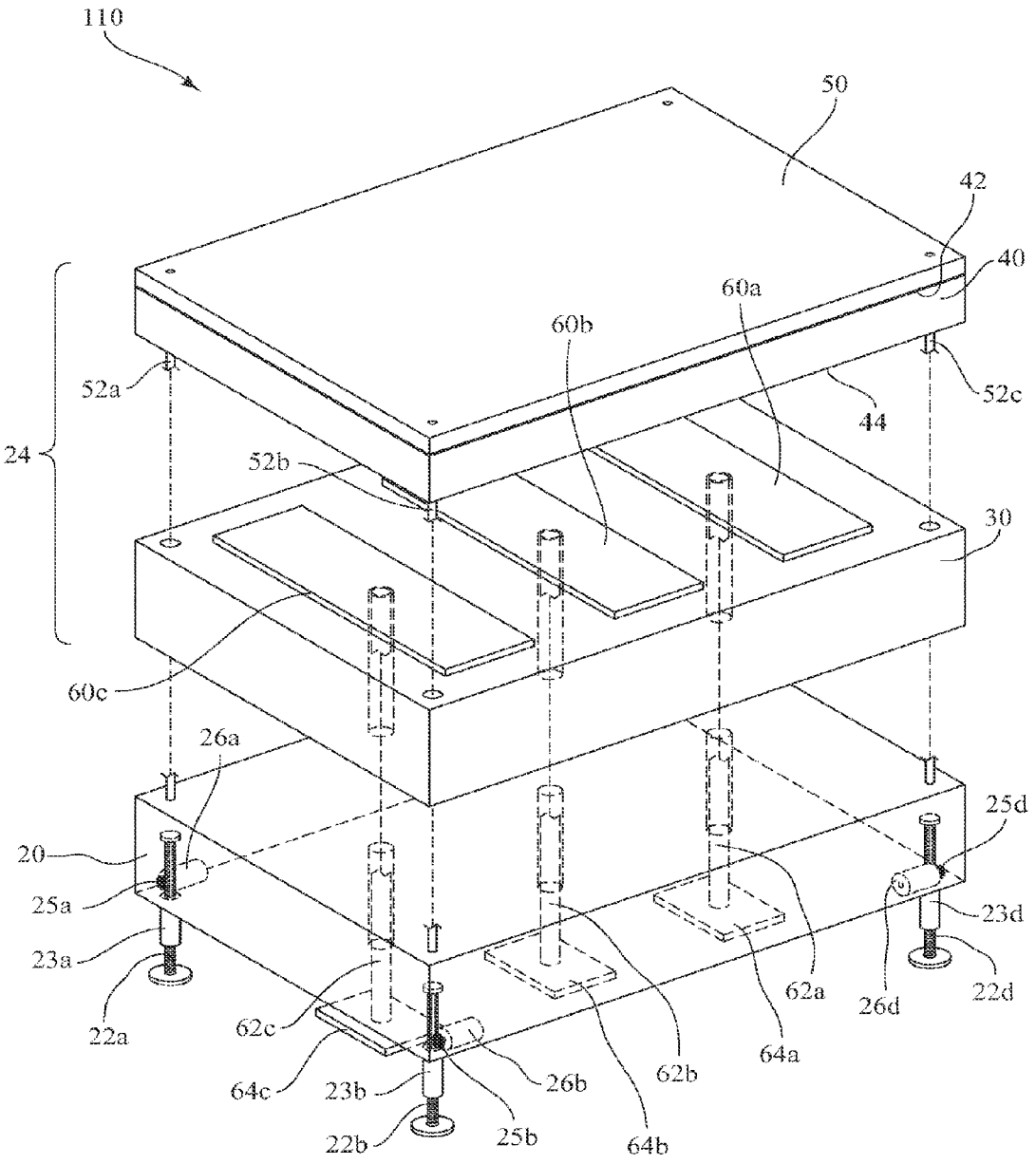
FIG. 4 is an exploded perspective view of another exemplary bed made in accordance with the present invention.
Figure 5:
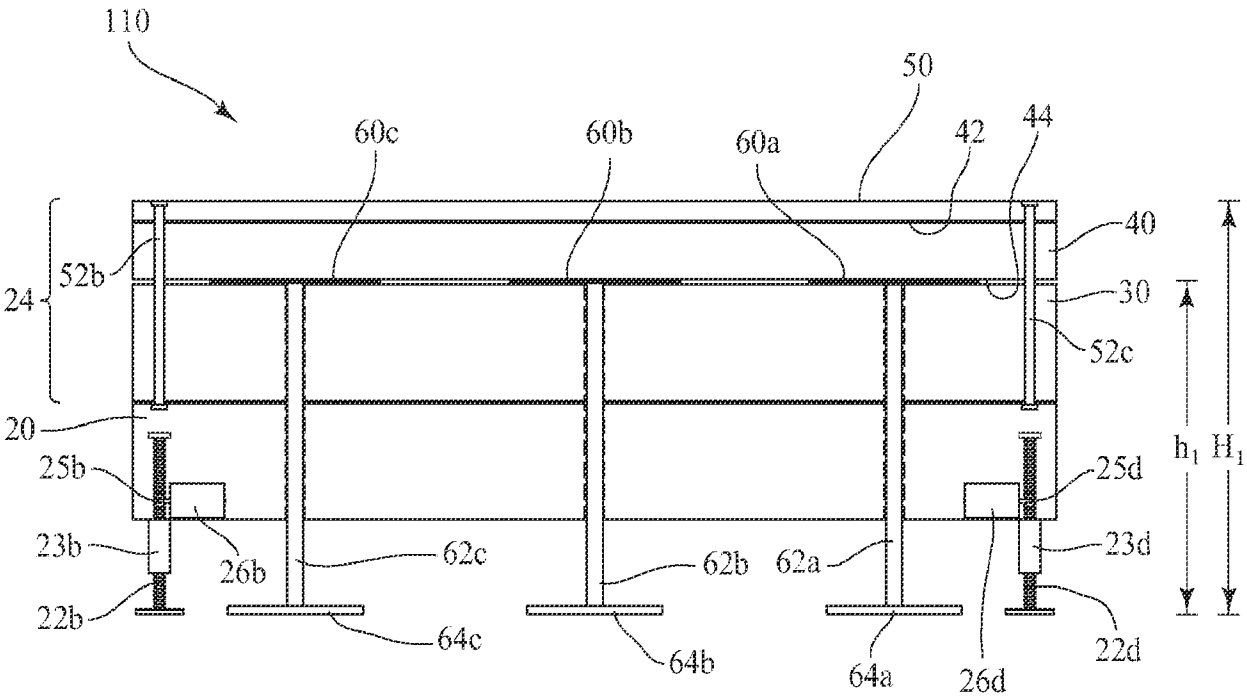
FIG. 5 is a side sectional view of the bed of FIG. 4 in an assembled form.
Figure 6:
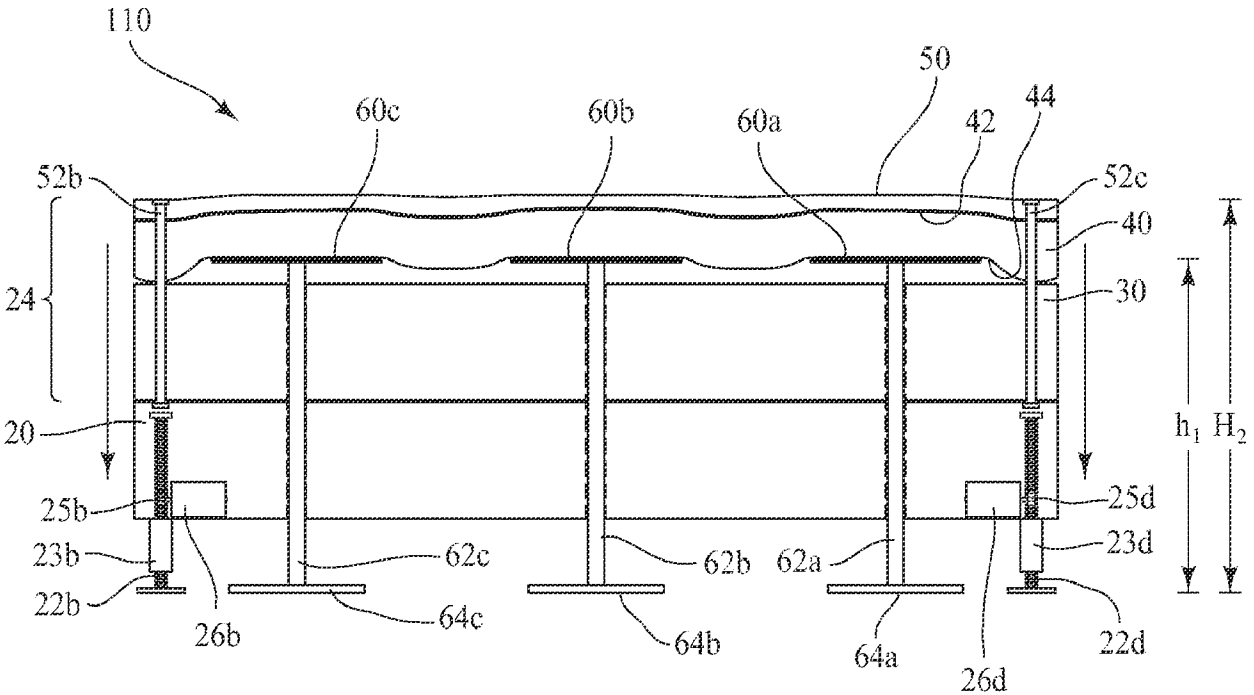
FIG. 6 is a side sectional view of the bed of FIG. 5 in an assembled form where the height of the foundation of the bed has been lowered relative to the underlying floor.

FIGS. 4-6 are views of another exemplary bed made 110 in accordance with the present invention. The exemplary bed 110 is substantially identical to the bed 10 described above with respect to FIGS. 1-3, comprising: a foundation (for example, a box-spring mattress) 20; and a mattress assembly 24, including a base layer 30 and a body supporting portion 40 with an optional upper comfort layer 50. The only difference is that, rather than having a single, continuous internal plate, the bed 110 has three separate and discrete internal plates 60*a*, 60*b*, 60*c*. A first plate 60*a* is in an area that would accommodate the head of a user, a second plate 60*b* is in an area that would accommodate the hips of the user, and a third plate 60*c* is in an area that would accommodate the feet of the user. In other words, the plates 60*a*, 60*b*, 60*c* are positioned in the areas where additional firmness might be desirable, especially when a user is getting into or out of the bed 110.

One of ordinary skill in the art will recognize that additional embodiments are possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. A bed, comprising:

a foundation configured to be positioned on an underlying floor;

a mattress assembly supported on and secured to the foundation, the mattress assembly including a base layer and a body supporting portion; and one or more internal plates interposed between the base layer and the body supporting portion of the mattress assembly, the one or more internal plates being supported on one or more legs extending through the base layer and the foundation and that maintain the one or more internal plates at a fixed height relative to the underlying floor;

wherein the foundation and the mattress assembly are moveable between at least a first predetermined height and a second predetermined height relative to the underlying floor, and wherein, as a result of the movement of the foundation and the mattress assembly between the first predetermined height and the second predetermined height, the one or more internal plates apply pressure to and compress the body supporting portion of the mattress assembly.

2. The bed of claim 1, wherein the body supporting portion is comprised of a flexible foam.

3. The bed of claim 2, wherein the flexible foam is a visco-elastic foam.

4. The bed of claim 1, wherein the base layer is comprised of a high-resilience foam.

5. The bed of claim 4, wherein the high-resilience foam is a high-resilience polyurethane foam.

6. The bed of claim 1, wherein the mattress assembly further includes an upper comfort layer that is positioned atop the body supporting portion.

7. The bed of claim 6, wherein the upper comfort layer is comprised of a flexible foam.

8. The bed of claim 7, wherein the flexible foam is a visco-elastic foam.

9. The bed of claim 1, wherein the bed has only one internal plate that is substantially coextensive with a lower surface of the body supporting portion of the mattress assembly.

10. The bed of claim 1, wherein the bed has multiple internal plates.

11. The bed of claim 10, wherein the bed has three internal plates, a first plate in an area that would accommodate the head of a user, a second plate in an area that would accommodate the hips of the user, and a third plate in an area that would accommodate the feet of the user.

12. The bed of claim 1, and further comprising multiple adjustable legs extending from a lower surface of the foundation for facilitating movement of the foundation and the mattress assembly between the first predetermined, height and the second predetermined height relative to the underlying floor.

* * * * *